US006882097B2

(12) United States Patent
Abe et al.

(10) Patent No.: US 6,882,097 B2
(45) Date of Patent: Apr. 19, 2005

(54) DEFLECTION YOKE

(75) Inventors: Fumio Abe, Tokyo (JP); Takashi Sugahara, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 3 days.

(21) Appl. No.: 09/993,619

(22) Filed: Nov. 27, 2001

(65) Prior Publication Data

US 2002/0185956 A1 Dec. 12, 2002

(30) Foreign Application Priority Data

Jun. 7, 2001 (JP) ..... 2001-172045

(51) Int. Cl.[7] ..... H01J 29/70

(52) U.S. Cl. ..... 313/440; 313/421; 315/399; 335/210

(58) Field of Search ..... 313/421, 440, 313/442; 315/399; 335/209, 210

(56) References Cited

U.S. PATENT DOCUMENTS

| | | | | | |
|---|---|---|---|---|---|
| 3,601,731 | A | * | 8/1971 | Christiana et al. | 335/300 |
| 4,484,166 | A | * | 11/1984 | Osinga et al. | 335/213 |
| 5,412,362 | A | * | 5/1995 | Ikeuchi | 335/213 |
| 5,446,432 | A | * | 8/1995 | Ikeuchi | 335/213 |
| 5,714,921 | A | * | 2/1998 | Aoki | 335/213 |
| 5,828,278 | A | * | 10/1998 | Murata | 335/213 |
| 5,942,845 | A | | 8/1999 | Matsubara | |

FOREIGN PATENT DOCUMENTS

| | | | | |
|---|---|---|---|---|
| EP | 572192 A1 | * | 12/1993 | H01J/9/236 |
| JP | 01151134 A | * | 6/1989 | H01J/29/76 |
| JP | 06168677 A | * | 6/1994 | H01J/29/76 |
| JP | A7-29513 | | 1/1995 | |
| JP | 63-261657 A | | 10/1999 | |
| JP | 2000-67780 A | | 3/2000 | |
| JP | 2001-126640 A | | 5/2001 | |

* cited by examiner

*Primary Examiner*—Ashok Patel
*Assistant Examiner*—German Colón
(74) *Attorney, Agent, or Firm*—Birch, Stewart, Kolasch & Birch, LLP.

(57) ABSTRACT

A deflection yoke apparatus include a saddle-type coil bobbin, first guide grooves, second guide groove, third guide groove, and a multi-wire conductor. The saddle-type coil bobbin has a front end portion and a rear end portion. The first guide grooves is formed in the inner surface of the coil bobbin and extends across the front end portion and the rear end portion. The second guide groove is formed in the front end portion of the coil bobbin. The third guide groove is formed in the rear end portion of the coil bobbin. The multi-wire conductor is wound around the coil bobbin, the conductor being routed through the first guide groove, the second guide groove, and the third guide groove. The second guide groove and third guide groove have a width in a range of 1.0 to 1.5 times the diameter of the conductor.

4 Claims, 7 Drawing Sheets

DEFLECTION YOKE

BACKGROUND OF THE INVENTION

1. Field of the Invention

The present invention relates to a deflection yoke for use with a color CRT having an in-line type electron gun.

2. Description of the Related Art

A deflection yoke is mounted on a neck of a color CRT in which three electron guns are incorporated. The deflection yoke is energized to magnetically deflect three electron beams both horizontally and then vertically so as to scan the entire area of the inner surface of the CRT. FIG. 4 is a general perspective view of a conventional deflection yoke 1. A coil bobbin 2 is formed of a plastic material and supports associated components thereon. The coil bobbin 2 separates the horizontal coil 3 and the vertical coil 4 from each other and therefore is referred to as a separator of the deflection yoke 1.

The horizontal deflection coil 3 includes two subassemblies, each assembly being substantially in the shape of a saddle. The two subassemblies are aligned in the deflection yoke, vertically and symmetrically with respect to a horizontal axis. Likewise, the vertical deflection coil 4 includes two subassemblies, each assembly being in the shape of a saddle. The two subassemblies are aligned in a space outside of the coil bobbin 2, horizontally and symmetrically with respect to a vertical axis. A ferrite core 5 is disposed in a space outside of the vertical coil 4 so that both the horizontal coil 4 and vertical coil 3 provide magnetic deflection of the three beams with increased efficiency.

FIG. 5 is a graphical representation of the shape of the horizontal deflection coil 3. FIG. 6 is a graphical representation of the shape of the vertical deflection coil 4. The horizontal deflection coil 3 and vertical deflection coil 4 each have two assemblies of a symmetrical shape. FIGS. 5 and 6 each illustrate these two assemblies when they are assembled together. The magnetic field produced by linear portions of the respective saddle-shaped coils depicted at "A" is the major portion of the magnetic field that contributes to the magnetic deflection of electron beams. The arcuate portions in FIGS. 5 and 6 correspond to arcuate portions of FIG. 7.

A deflection yoke is required to perform two tasks: deflection of three electron-beams horizontally and vertically and convergence of the three beams on the inner surface of the screen of the color CRT. In order to achieve these tasks, the actual deflection yoke is required to generate appropriate magnetic fields, thereby necessitating complex shapes of portions depicted at "A" in FIGS. 5 and 6 which generate useful magnetic fields.

FIG. 7 illustrates an example of a deflection yoke in which actual coils are wound on the coil bobbin 2. FIG. 7 shows only an upper portion of the horizontal coil and a lower portion is omitted since the upper and lower portions are symmetrical in shape. The conductors that form the horizontal deflection coil and vertical deflection coil are of a multi-wire type in which several tens of thin wires of 0.1-0.2 mm in diameter are bundled into a single conductor having a diameter of about 1 mm.

Referring to FIG. 7, the coil bobbin 2 is formed with grooves 6 (i.e., wire channel) in the inner surface thereof, the grooves 6 accommodating the turns of horizontal coil 3 therein. Thus, properly arranging the grooves 6 allows a properly distributed magnetic field that causes the electron beams to converge on the inner surface of the panel of the CRT. When assembling the deflection yoke, the conductor needs to be turned with tension, so that the turns of conductor are accurately disposed in the grooves 6 of the coil bobbin. In practice, hook-like projections 9 and 10 are provided on the front end and rear end of the coil bobbin 2. The conductor is led out of one groove 6 with tension applied to the conductor then the conductor is turned around the hook-like projections 9 and 10 to be guided into the next groove FIG. 8 is a cross-sectional view illustrating the positional relation among the hook-like projections 9, groove 6, and multi-wire conductor of the horizontal deflection coil 3. The conductor of the horizontal deflection coil 3 passes through an arcuate groove 7 provided at the front end of the deflection yoke, turns around the hook-like projection 9 to be redirected, and then enters the groove 6 formed in the coil bobbin 2. Several conductors of the horizontal deflection coil 3 are accommodated in the groove 7 and each of the grooves 6. The distribution of magnetic field produced by the entire horizontal coil 3 is determined by the arrangement of the groove 6 in the coil bobbin 2. It is common that the diameter of the multi-wire conductor of the horizontal coil 3 is about $\phi$=1 mm and the width of the groove 7 is about H=5 mm. Here, when the conductor is led out of the groove 7 at the front and is bent at the hook-like projection 9 into the groove 6 formed in the coil bobbin 2, a tension force is applied to the conductor. Therefore, the turns of the horizontal coil 3 are randomly placed one after another near the hook-like projections 9. This implies that the turns of the horizontal coil are not regularly layered one after the other in the grooves 6 that play critical roles in the deflection operation of the deflection yoke and adjustment of convergence.

Recent CRTs, especially, color picture tubes for a display monitor are used to display high-resolution images that require excellent convergence performance. Convergence performance is determined by the arrangement of the turns of coil in the grooves. With the aforementioned conventional deflection yoke, there is no regularity in the turns of coil placed in the grooves. Thus, the lack of regularity inherently results in variations in convergence that is not negligible. Such a deflection yoke is not suitable for ensuring regularity of turns of coil in the grooves.

Deflection yokes have particularly stringent convergence requirements, for example in the field of a color picture tube for a display monitor. Thus, deflection yokes should have minimal variations in their deflection performance.

SUMMARY OF THE INVENTION

Thus, the irregularity of arrangement of a deflection coil accommodated in the aforementioned grooves cannot be neglected. The present invention was made in view of the aforementioned drawbacks of the conventional deflection yoke.

An object of the present invention is to provide a deflection yoke that can be manufactured by the conventional technology and yet has reduced variations in convergence performance.

A deflection yoke apparatus include a saddle-type coil bobbin, first guide grooves, at least second guide groove, at least third guide groove, and a multi-wire conductor. The saddle-type coil bobbin has a front end portion and a rear end portion. The first guide grooves is formed in the inner surface of the coil bobbin and extends across the front end portion and the rear end portion. The at least second guide groove is formed in the front end portion of the coil bobbin. The at least third guide groove is formed in the rear end portion of the coil bobbin. The multi-wire conductor is wound around the coil bobbin, the conductor being routed through the first guide groove, the at least second guide groove, and the third guide groove. The second guide groove and third guide groove has a width in a range of 1.0 to 1.5 times a diameter of the conductor.

The at least one second guide groove may be one of a plurality of second guide grooves aligned in parallel and the at least one third guide groove may be one of a plurality of third guide grooves aligned in parallel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DESCRIPTION OF PREFERRED EMBODIMENTS

Embodiments of the present invention will be described in detail with reference to the accompanying drawings.

First Embodiment

A deflection yoke according to a first embodiment includes a conductor that is wound on a saddle-type coil bobbin having a front portion and a rear portion end. The saddle-shaped coil bobbin has guide grooves formed in an inner surface thereof, the guide grooves extending from the front portion to the rear portion to guide turns of coil. The front portion of the coil bobbin has hook-like projections and another guide grooves that guide the conductor. The rear portion of the coil bobbin has hook-like projections and still another guide grooves for guiding the conductor therein.

Figure 1:
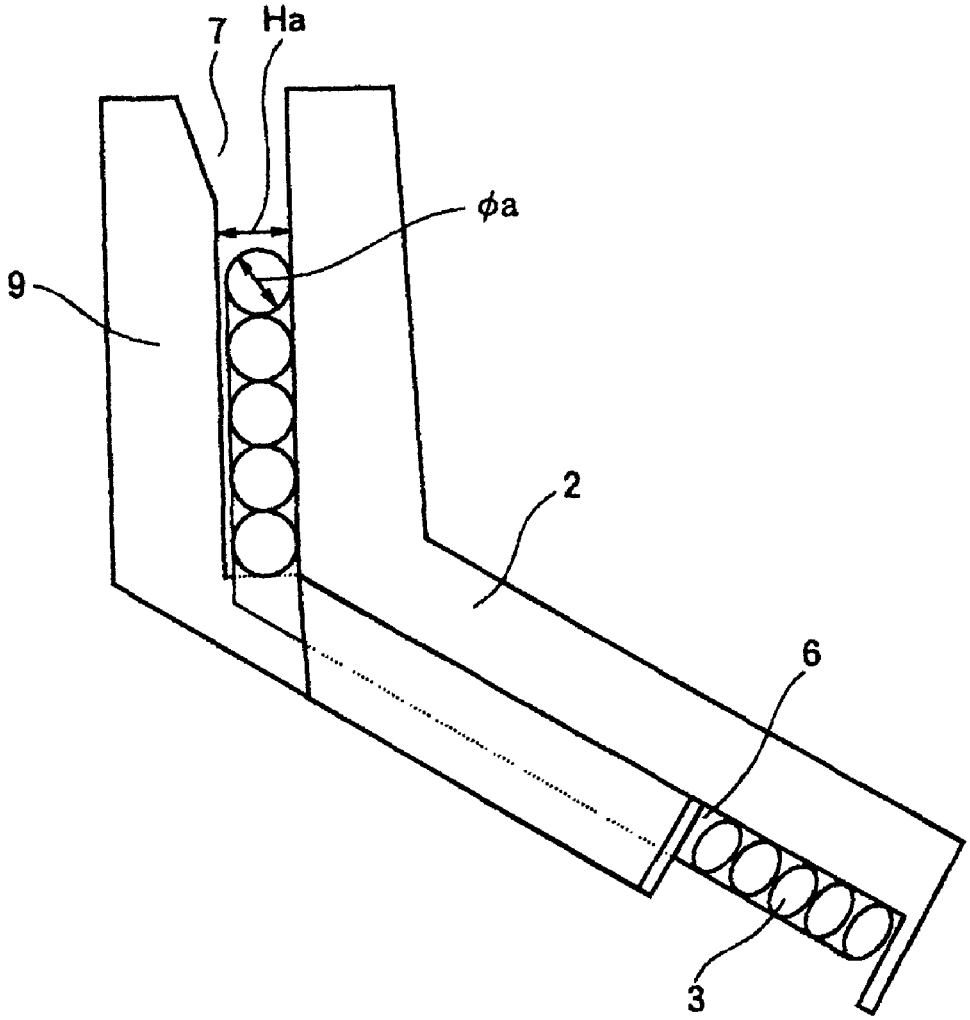
FIG. 1 is a cross-sectional view of a horizontal deflection coil in a deflection yoke according to an embodiment of the present invention.

FIG. 1 is a cross-sectional view of a horizontal deflection coil in a deflection yoke according to an embodiment of the present invention. Referring to FIG. 1, a multi-wire conductor of the horizontal deflection coil has a diameter ϕa and is mounted on the bobbin with tension applied to the coil. There is provided an arcuate front groove 7 between the coil bobbin 2 and the hook-like projections 9 that oppose the coil bobbin. The grooves 7 has a width Ha in the range of 1.0 to 1.5 times the diameter ϕa of the conductor. The coil bobbin 2 can have as many grooves 6 as required. The conductor is wound a plurality of turns on the coil bobbin in such a way that the turns of the coil are layered in the grooves 6 in sequence. Thus, the turns of the coil accommodated in the respective grooves 6 are neatly, regularly layered in the order of winding operation as opposed to the conventional art in which each turn irregularly lies in randomly available space.

Second Embodiment

Figure 7:
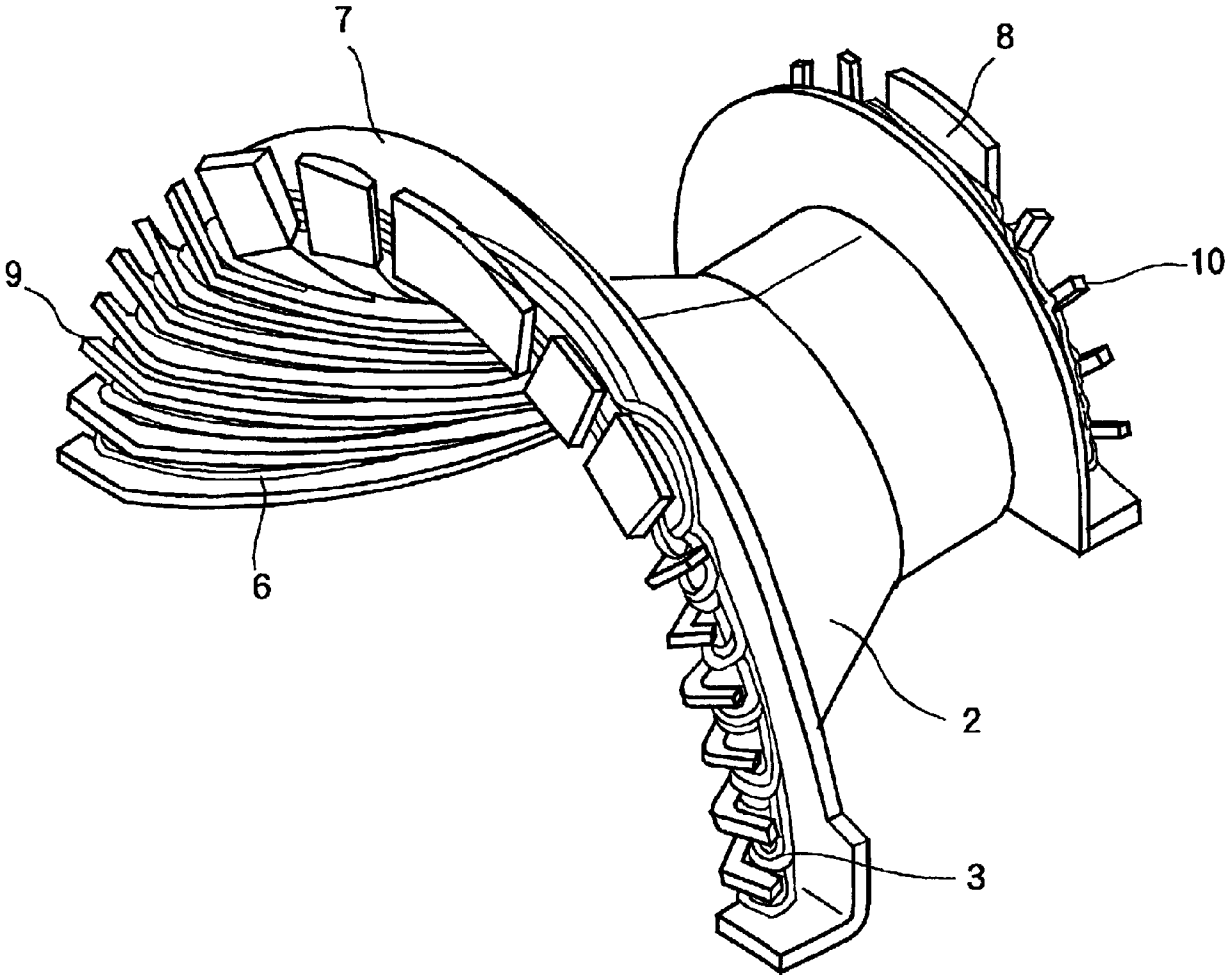
FIG. 7 illustrates an example of a deflection yoke in which actual coils are wound on the coil bobbin.
Figure 8:
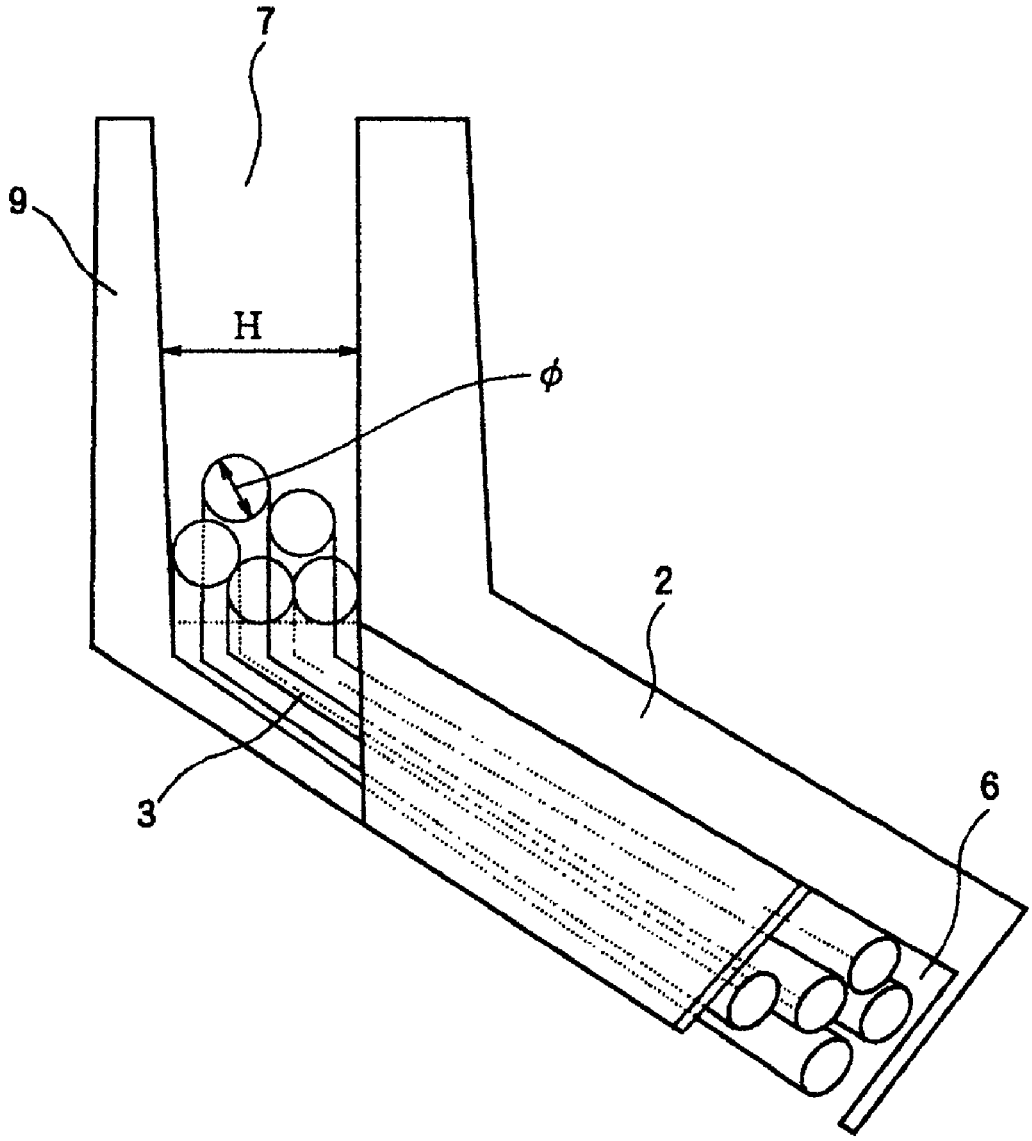
FIG. 8 is a cross-sectional view illustrating the positional relation among the hook-like projections, groove, and multi-wire conductor of the horizontal deflection coil.

In the first embodiment, the distance between the hook-like projections 9 of the front side and the coil bobbin 2 is selected taking the diameter of the conductor into account such that the turns of coil can be regularly laid in the groove 6 of the coil bobbin 2. However, as shown in FIG. 7, the coil bobbin 2 has a plurality of grooves 6 formed therein. Therefore, the groove 7 formed on the front side of the deflection yoke will accommodate a large number of turns of coil, concentrated in the rather narrow groove 7 such that the turns of the coil are layered one over the other with their cross-sections aligned in a single line.

Figure 2:
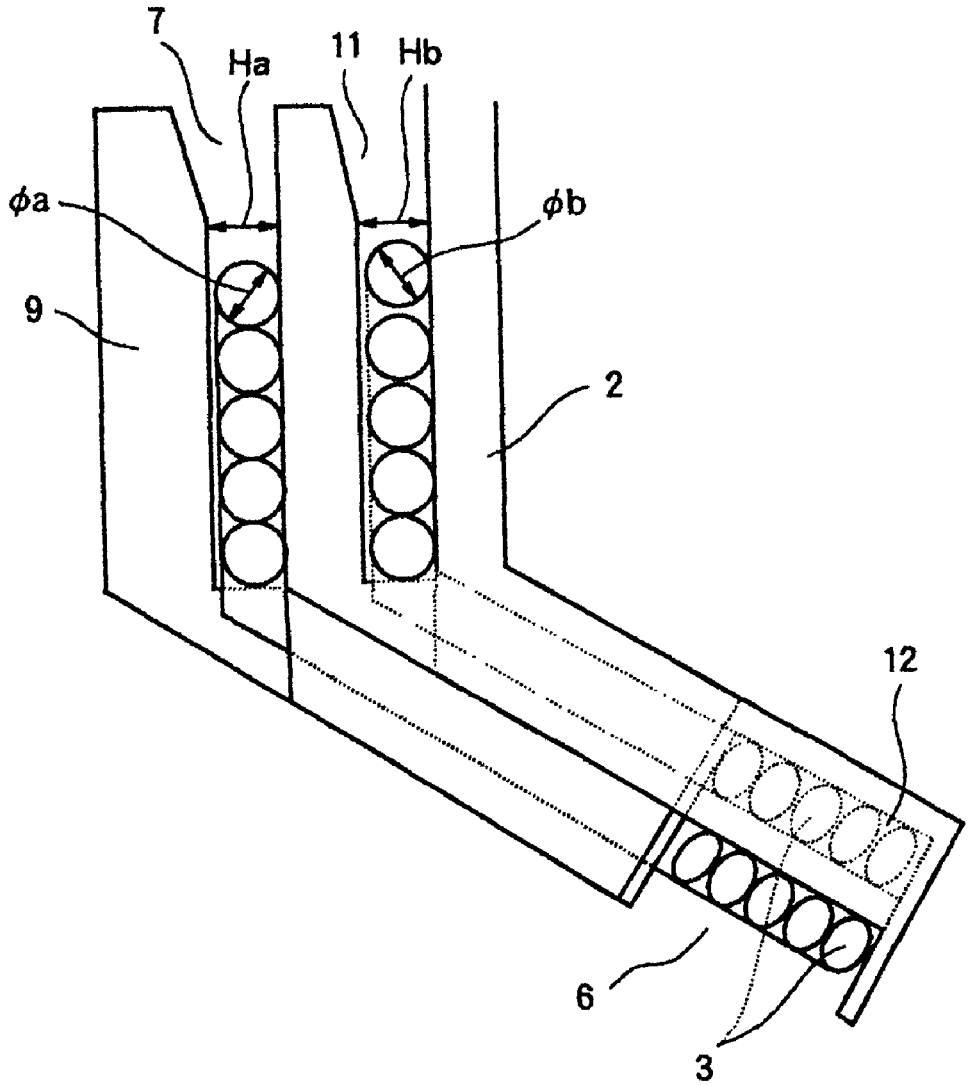
FIG. 2 is a cross-sectional view of a horizontal deflection coil according to the second embodiment.
Figure 3:
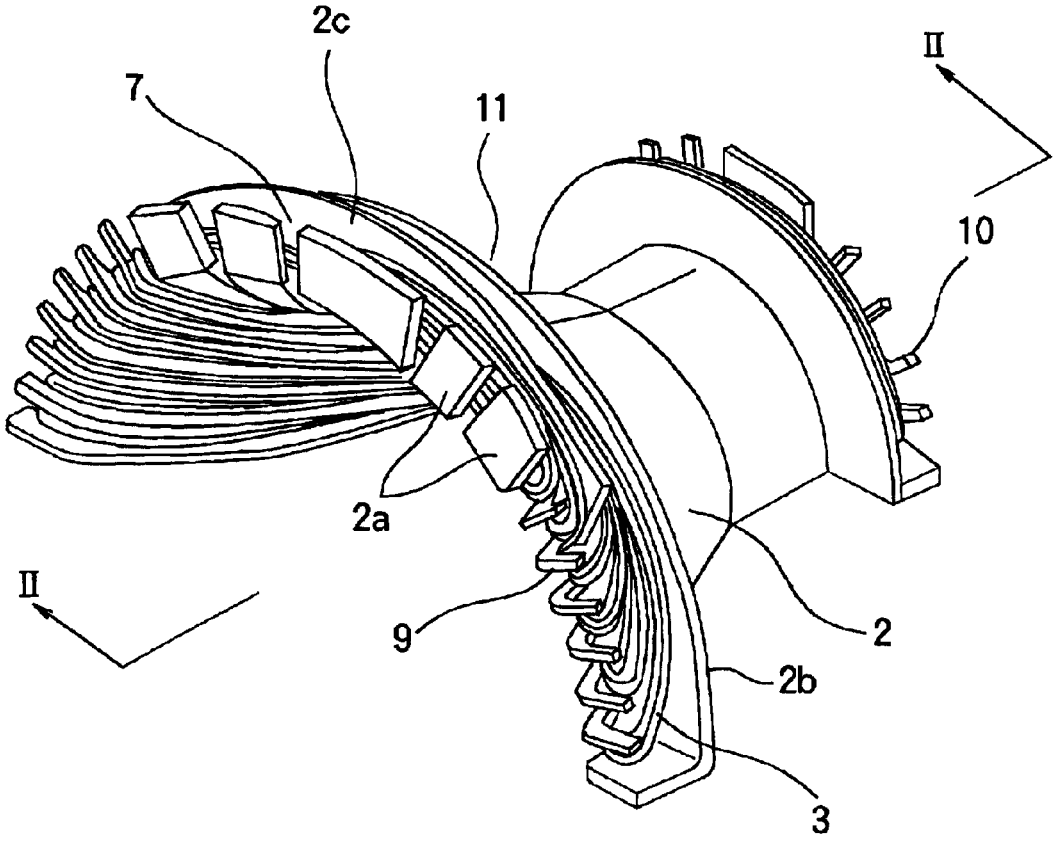
FIG. 3 is a perspective view illustrating an appearance of the deflection yoke according to the second embodiment.
Figure 4:
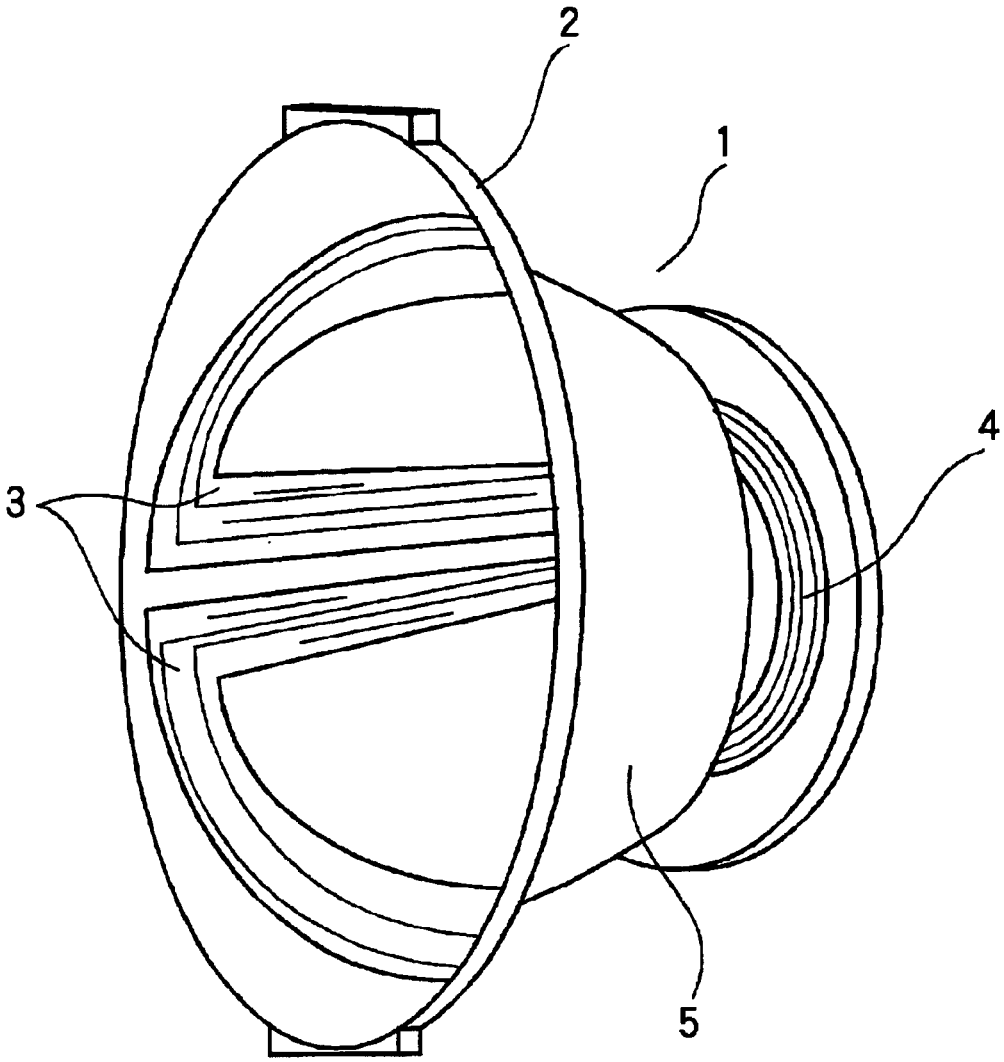
FIG. 4 is a general perspective view of a conventional deflection yoke.
Figure 5:
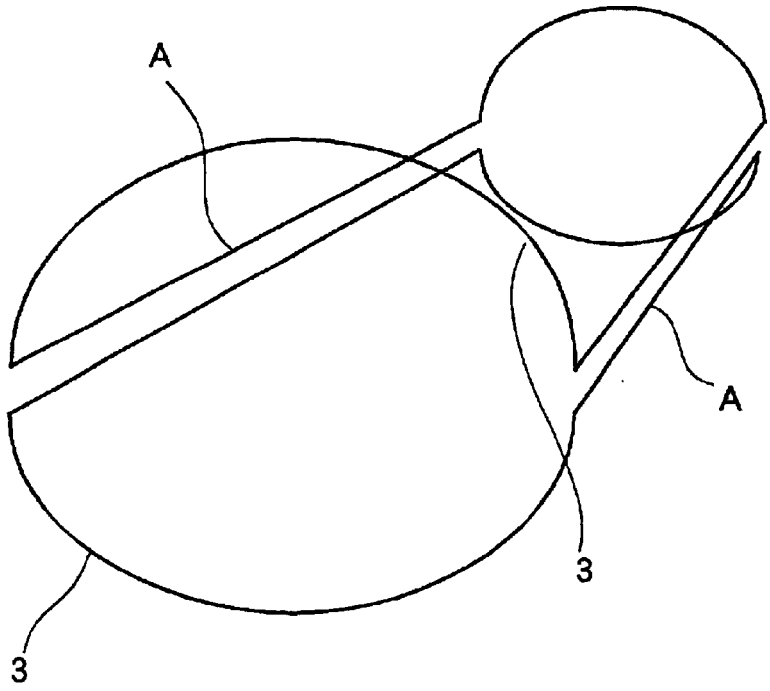
FIG. 5 is a graphical representation of the shape of the horizontal deflection coil.
Figure 6:
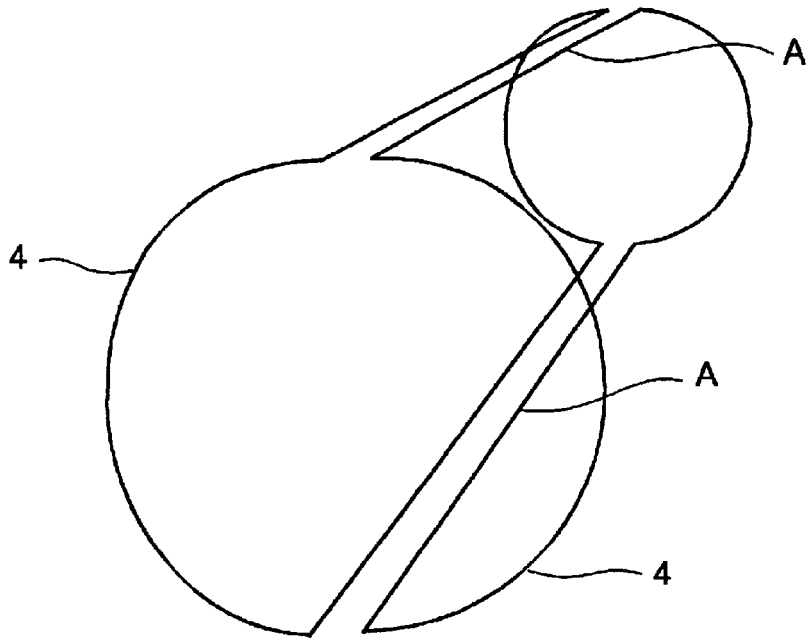
FIG. 6 is a graphical representation of the shape of the vertical deflection coil.

In order to solve the problem that a large number of turns of coil are concentrated in layers within the single groove 7, a coil bobbin of a second embodiment has another groove 11. FIG. 2 is a cross-sectional view of a horizontal deflection coil according to the second embodiment. FIG. 3 is a perspective view illustrating an appearance of the deflection yoke according to the second embodiment. FIG. 2 is a cross-sectional view taken along lines II-II.

Referring to FIG. 3, a partition 2*c* extends between the groove 7 and the groove 11 such that the groove 7 and the groove 11 extend in parallel. The partition 2*c* is symmetrical with respect to a vertical axis passing through the coil bobbin 2. The width Hb of the groove 11 of FIG. 2 is selected to be in the range of 1.0 to 1.5 times the diameter ϕa. In other words, the width Hb of the groove 11 can be the same as the width Ha of the groove 7. The turns of coil that are laid in grooves 12 formed in the coil bobbin 2 are directed from the groove 11 and not from the groove 7, so that the turns of the coil will not be concentrated only in the groove 7.

While the invention has been described with respect to the front side of the horizontal deflection yoke, the construction according to the invention can also be applied to the front side and rear side of the vertical deflection coil that are mounted outside of the deflection yoke. The second embodiment has been described with respect to a two-groove configuration, i.e., the groove 7 and groove 11. More grooves may be provided while offering the same advantages and effects.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A deflection yoke apparatus, comprising:

a saddle-type coil bobbin having a front end portion and a rear end portion;

first guide grooves formed in an inner surface of said coil bobbin and extending across the front end portion and the rear end portion;

at least one second guide groove formed in the front end portion;

at least one third guide groove formed in the rear end portion;

a multi-wire conductor wound around said coil bobbinto form a coil, the conductor having a substantially circular cross-section and being routed through said first guide grooves, said at least one second guide groove, and said at least one third guide groove such that respective turns of the coil are sequentially layered in said first guide groove in a winding sequence order;

wherein said second guide groove and third guide groove have a width in a range of 1.0 to 1.5 times a diameter of said conductor.

2. The deflection yoke according to claim 1, wherein said at least one second guide groove is one of a plurality of second guide grooves aligned in parallel and said at least one third guide groove is one of a plurality of third guide grooves aligned in parallel.

3. A deflection yoke apparatus, comprising:

a saddle-type coil bobbin having a front end portion and a rear end portion;

first guide grooves formed in an inner surface of said coil bobbin and extending across the front end portion and the rear end portion;

at least one second guide groove formed at the outer surface of the front end portion;

at least one third guide groove formed at the outer surface of the rear end portion;

a multi-wire conductor wound around said saddle-type coil bobin to form a coil, the conductor having a substantially circular cross section and being routed through said first guide grooves, said at least one second guide groove, and said at least one third guide groove such that respective turns of the coil are sequentially layered in said first guid groove in a winding sequence order;

wherein said at least one second guide groove and said at least one third guide groove have a width in a range of 1.0 to 1.5 times a diameter of said conductor and said conductor being laid substantially side by side in said first guide grooves, said at least one second guide groove, and siad at least one third guide groove.

4. The deflection yoke according to claim 3, wherein said at least one second guide groove is one of a plurality of second guide grooves aligned in parallel and said at least one third guide groove is one of a plurality of third guide grooves aligned in parallel;

wherein the conductor is wound in layers that are placed one over the other in the second guide grove in such a way that when a preceding one of adjacent layers is formed, the conductor is routed through a preceding one of adjacent ones of the plurality of second grooves, and when a following one of the adjacent layers is formed, the conductor is routed through a following one of the adjacent ones of the plurality of second grooves and a following one of the adjacent ones of the plurality of third guide grooves.

* * * * *